United States Patent [19]

Shirai et al.

[11] Patent Number: 4,965,489

[45] Date of Patent: Oct. 23, 1990

[54] ELECTRON GUN FOR CATHODE-RAY TUBE

[75] Inventors: Shoji Shirai, Mobara; Masaaki Yamauchi, Togane; Yasuo Tanaka, Ichihara, all of Japan

[73] Assignees: Hitachi, Ltd., Tokyo; Hitachi Device Engineering Co., Ltd., Mobara, both of Japan

[21] Appl. No.: 334,342

[22] Filed: Apr. 7, 1989

[30] Foreign Application Priority Data

Apr. 8, 1988 [JP] Japan ..... 63-85077

[51] Int. Cl.[5] ..... H01J 29/62

[52] U.S. Cl. ..... 313/449; 313/456

[58] Field of Search ..... 313/414, 449, 456, 457

[56] References Cited

U.S. PATENT DOCUMENTS 3,883,771 5/1975 Ohgoshi et al. ..... 313/414 X 4,271,374 6/1981 Kimura ..... 313/449

4,620,134 10/1986 Peels et al. ..... 313/414 X

FOREIGN PATENT DOCUMENTS 58-31696 7/1983 Japan .

*Primary Examiner*—Kenneth Wieder

*Attorney, Agent, or Firm*—Antonelli, Terry, Stout & Kraus

[57] ABSTRACT

An electron gun for a cathode-ray tube has a structure in which the longitudinal middle portion of a focusing electrode is enlarged in diameter and an accelerating electrode is disposed in the enlarged-diameter portion of the focusing electrode. The opposite end portions of the focusing electrode are reduced in diameter, and the reduced-diameter portions of the focusing electrode and the accelerating electrode are secured to each other by means of electrode supporting rods.

8 Claims, 7 Drawing Sheets

ELECTRON GUN FOR CATHODE-RAY TUBE

BACKGROUND OF THE INVENTION

1. Field of the Invention

The present invention relates to an electron gun for a cathode-ray tube and, more particularly, to an electrode structure in which it is possible to enlarge the diameter of the opening of a principal lens.

2. Description of the Related Art

FIG. 2 is a diagrammatic cross-sectional view of a cathode-ray tube provided with an electron gun employing a conventional BPF (bi-potential-focusing) type of principal lens. In the figure, the inner surface of a face plate 2 which constitutes a part of a glass envelope 1 is covered with a phosphor screen 3, and a triode section which serves as electron-beam generating means is constituted by a cathode 4, a G1 electrode 5, and a G2 electrode 6. An electron beam 11 is generated in the triode section and immediately focused to form a cross-over. Immediately after the cross-over, the electron beam 11 diverges and is again focused by a principal lens which is constituted by a focusing electrode 7 and an accelerating electrode 8. The accelerating electrode 8 is electrically connected through a spring contact 9 to a conducting layer 10 which is deposited on the inner surface of a predetermined portion of the glass envelope 1, whereby an equipotential space which extends between the accelerating electrode 8 and the phosphor screen 3 is formed. The electron beam 11 which is focused by the principal lens passes through the equipotential space and forms a beam spot on the phosphor screen 3. A magnetic deflection yoke 12 is provided so as to allow scanning of the beam spot on the phosphor screen 3. The G1 electrode 5, the G2 electrode 6, the focusing electrode 7, and the accelerating electrode 8 are spaced apart at predetermined intervals in the axial direction and secured in a coaxial relationship by means of electrode supporting rods 13 and 13' made of an insulating material such as glass.

The BPF type principal lens is formed by applying a focusing voltage having, for example, a low potential of approximately 5–10 kV to the focusing electrode 7 and, at the same time, applying an accelerating voltage having, for example, a high potential of approximately 20–35 kV to the acelerating electrode 8.

One primary factor which seriously influences the resolution characteristics of a cathode-ray tube is the spherical aberration of the principal lens thereof. As is well known, the enlargement of the diameter of the opening of each electrode which constitutes a principal lens is effective in reducing the spherical aberration of the principal lens. However, the diameter of the electrode opening is limited by the inner diameter of the neck of the glass envelope 1 which accommodates the electron gun, and it is not preferable to enlarge the inner diameter of the neck for the purpose of enlarging the diameter of the electrode opening since this would inevitably involve an increase in the electric power required for deflection.

In addition, the diameter of the electrode opening is limited by the electrode supporting rods 13 and 13' and it is thus impossible to fully enlarge the diameter of the electrode opening to coincide with the inner diameter of the neck.

For example, in the case of a cathode-ray tube having a neck with an outer diameter of 29 mm, the inner diameter of the neck is approximately 24 mm. Accordingly, if the presence of the electrode supporting rods 13 and 13' and the wall thickness of each electrode is taken into account, the respective diameters of the openings of the focusing electrode 7 and the accelerating electrode 8 are limited to approximately 12–13 mm.

Japanese Patent Examined Publication No. 58-31696 discloses a method which enables the diameter of an electrode opening to be made greater than the size as limited by electrode supporting rods. The structure of a principal lens utilizing this method will be described below with reference to FIG. 3.

The diameter of the opening portion of an accelerating electrode 18 which opposes the phosphor screen 3 is made as large as possible without going beyond the limit at which the outer surface of the accelerating electrode 18 would come into contact with the inner surface of the neck of the glass envelope 1. A focusing electrode 17 is partially disposed in the accelerating electrode 18, and the diameter of the opening portion of the focusing electrode 17 is enlarged to a size which does not allow any deterioration in the high-voltage resistance characteristic of the focusing electrode 17 with respect to the accelerating electrode 18. The respective portions of the focusing electrode 17 and the accelerating electrode 18 which oppose a triode section are reduced in diameter, and the reduced-diameter portions of the electrodes 17 and 18 are secured to each other by means of electrode supporting rods 113 and 113'.

With the above-described structure, it is possible to fully enlarge the diameter of the opening portion of the accelerating electrode 18 to coincide with the inner diameter of the neck of the glass envelope 1 in the vicinity of the opening portion of the focusing electrode 17 which opposes the accelerating electrode 18 and in which an electron leans is formed. For example, in the case of a cathode-ray tube having a neck with an outer diameter of 29 mm, the diameter of the opening portion of the accelerating electrode 18 can be made as large as 21 mm, and hence the diameter of the opening portion of the focusing electrode 17 can be made as large as 16 mm.

Several problems remain to be solved, however, in the related art described above. For example, although the accelerating electrode 18 can be made as large as possible without going beyond the limit at which the accelerating electrode 18 would come into contact with the inner surface of the neck, the diameter of the opening of the focusing electrode 17 cannot be sufficiently enlarged since its opening portion is disposed in the accelerating electrode 18. However, enlargement of the diameter of the opening portion of the focusing electrode 17 would be more effective in improving the spherical aberration characteristics of the principal lens. Accordingly, insufficient enlargement of the diameter of the opening portion of the focusing electrode 17 is unfavorable in terms of the desire to reduce the spot diameter of an electron beam and to enhance resolution.

SUMMARY OF THE INVENTION

It is therefore an object of the present invention to provide an electrode structure which enables the diameter of the opening portion of a focusing electrode to be made as large as possible without going beyond the limit at which the focusing electrode would come into contact with the inner surface of the neck of a glass envelope.

To achieve the above object, in accordance with the present invention, there is provided an electron gun for a cathode-ray tube having a structure in which the longitudinal middle portion of a focusing electrode is enlarged in diameter and an accelerating electrode is disposed in the enlarged-diameter portion of the focusing electrode. The opposite end portions of the focusing electrode is reduced in diameter, and the reduced-diameter portions of the focusing electrode and the accelerating electrode are secured to each other by means of electrode supporting rods.

In accordance with the present invention, the diameter of the opening portion of the focusing electrode can be made as large as possible without going beyond the limit at which the focusing electrode would come into contact with the inner surface of the neck of the glass envelope. Accordingly, it is possible to reduce spherical aberration and to enhance resolution of a cathode-ray tube.

DESCRIPTION OF THE PREFERRED EMBODIMENTS

Preferred embodiments of the present invention will be described below with reference to the accompanying drawings.

Figure 1:
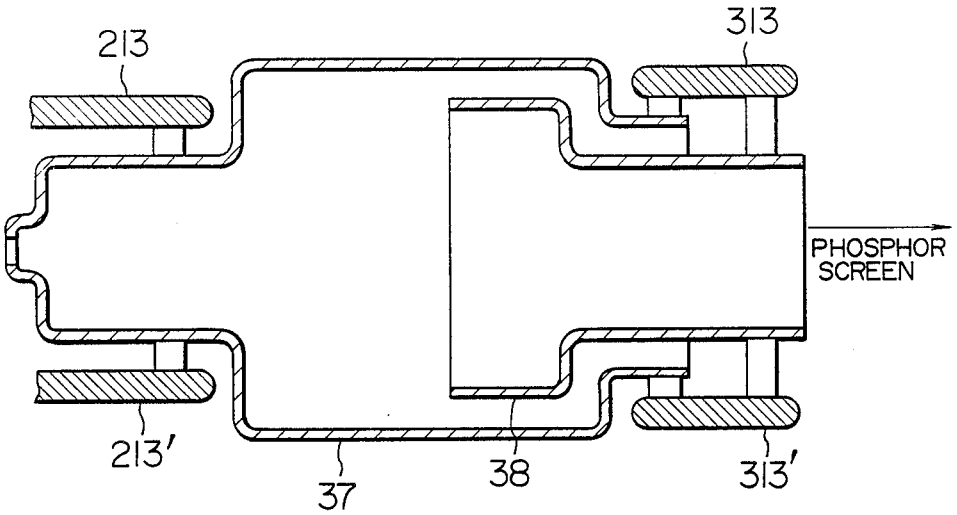
FIG. 1 is a diagrammatic cross-sectional view showing a principal lens according to a first embodiment of the present invention.

Referring to FIG. 1, the diameter of the axial middle portion of a focusing electrode 37 is made as large as possible, then a portion of an accelerating electrode 38 is accommodated in the enlarged middle portion, and then the opposite opening portions of the focusing electrode 37 are reduced in diameter. The portion of the accelerating electrode 38 which opposes the phosphor screen 3 is reduced in diameter and inserted through one of the reduced opening portions of the focusing electrode 37. The respective reduced opening portions of the focusing electrode 37 and the accelerating electrode 38 which oppose the phosphor screen 3 are secured to each other by means of electrode supporting rods 313 and 313'. The opposite reduced opening portion of the focusing electrode 37 as well as the cathode 4, the G1 electrode 5, and the G2 electrode 6 which constitute a triode section are secured axially at predetermined intervals by means of electrode supporting rods 213 and 213'.

Figure 4:
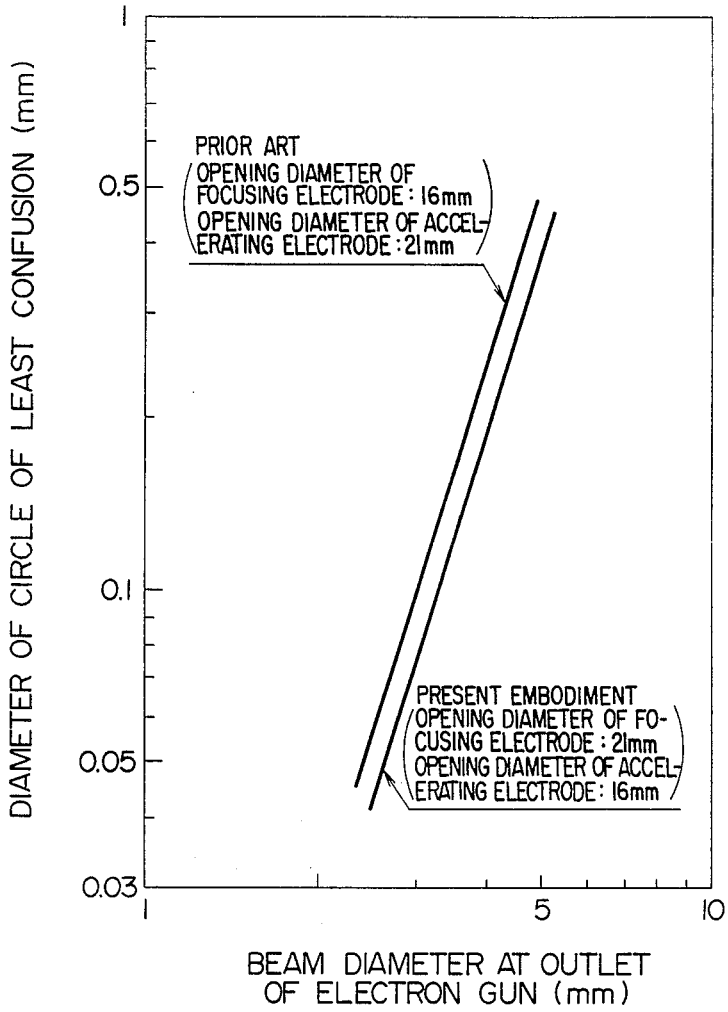
FIG. 4 is a graph showing a comparison between the values obtained by analysis of the spherical aberration characteristics of the conventional principal lens and those obtained by analysis of the same characteristics of the principal lens according to the first embodiment of the present invention.

FIG. 4 shows the result of analysis of the diameter of circle of least confusion of an electron beam on a phosphor screen due to the spherical aberration of a principal lens having the structure of FIG. 1. The conditions of the analysis are as follows:

* Diameter of opening of focusing electrode 37 . . . 21 mm
* Diameter of opening of accelerating electrode 38 . . . 16 mm
* Distance between phosphor screen 3 and end of accelerating electrode 38 (which opposes triode section) . . . 151 mm
* Ratio of focusing voltage to accelerating voltage . . . 28%

Figure 3:
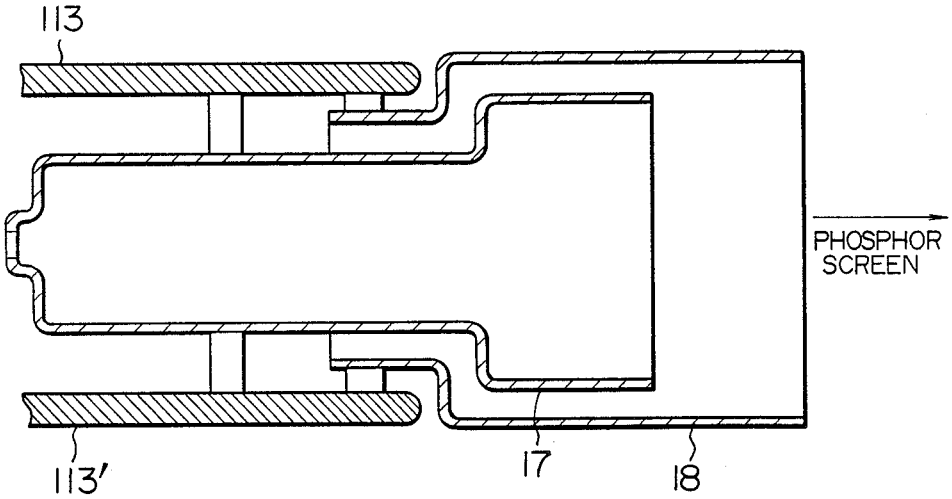
FIG. 3 PRIOR ART
FIG. 3 is a diagrammatic cross-sectional view showing the conventional principal lens.
Figure 2:
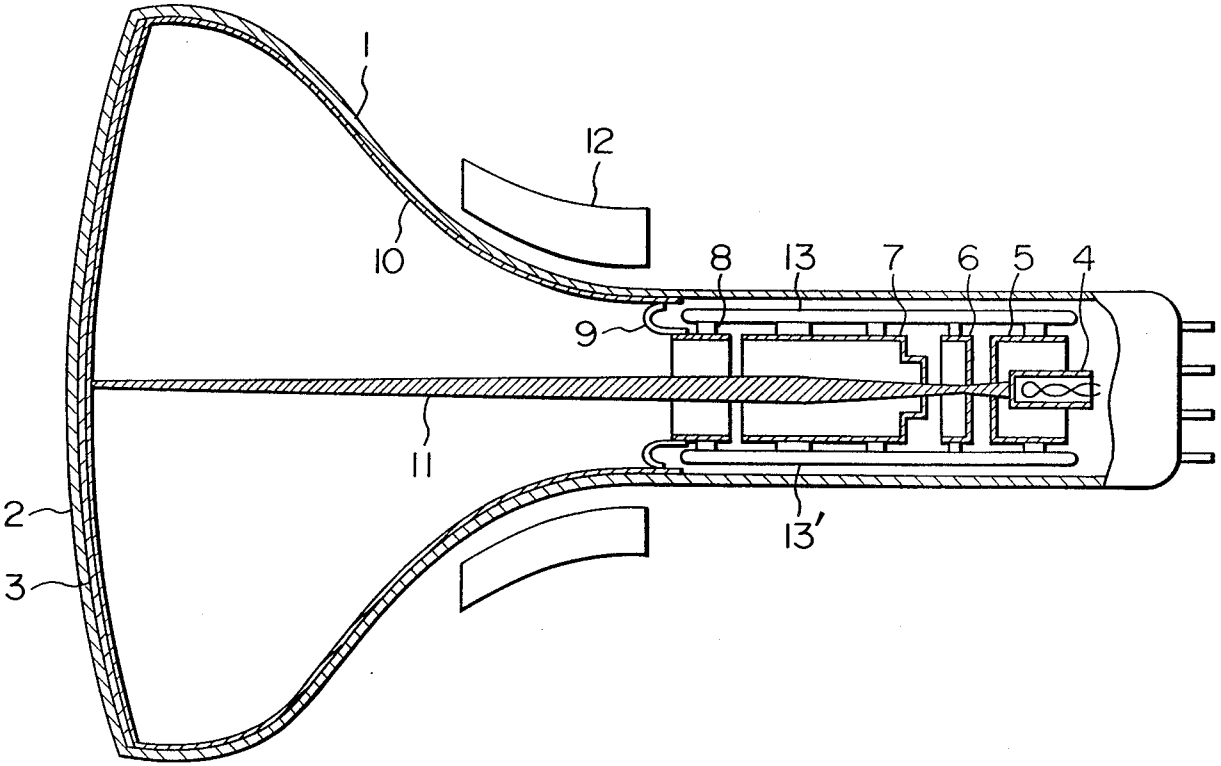
FIG. 2 PRIOR ART
FIG. 2 is a diagrammatic cross-sectional view showing a cathode-ray tube provided with a conventional principal lens.

In addition, FIG. 4 also shows the result of analysis of the diameter of circle of least confusion of an electron beam on a phosphor screen due to the spherical aberration of a principal lens having the conventional structure of FIG. 3. The conditions of the analysis are as follows:

* Diameter of opening of focusing electrode 17 . . . 16 mm
* Diameter of opening of accelerating electrode 18 . . . 21 mm
* Distance between phosphor screen 3 and end of focusing electrode 17 (which opposes phosphor screen 3) . . . 151 mm
* Ratio of focusing voltage to accelerating voltage . . . 28%

It is apparent from a comparison between the results of these analyses that, if the beam diameter at the outlet of an electron gun is the same, the principal lens of the present invention in which the diameter of its focusing electrode is made as large as possible enables a 27% reduction in the expansion of the beam spot on a phosphor screen due to spherical aberration compared with the conventional principal lens in which the diameter of its accelerating electrode is enlarged. Accordingly, with this first embodiment, it is possible to enhance the resolution of cathode-ray tubes compared with the resolution achieved by the conventional principal lens.

However, in order to make the diameters of the openings of both the focusing electrode 37 and the accelerating electrode 38 as large as possible for the purpose of improving spherical aberration, it is necessary to incorporate a special contrivance into the electrode structure according to the first embodiment. More specifically, in the first embodiment, if the focusing electrode 37 is integrally formed in advance, it will be impossible to insert the accelerating electrode 38 into the focusing electrode 37 as long as the outer diameter of the enlarged opening portion of the accelerating electrode 38 is larger than the inner diameter of the reduced opening portion of the focusing electrode 37. If the accelerating electrode 38 is to be inserted into the focusing electrode 37, the diameter of the opening of the accelerating electrode 38 must be reduced to approximately 12–13 mm, and the characteristic of spherical aberration is therefore deteriorated.

Figure 5:
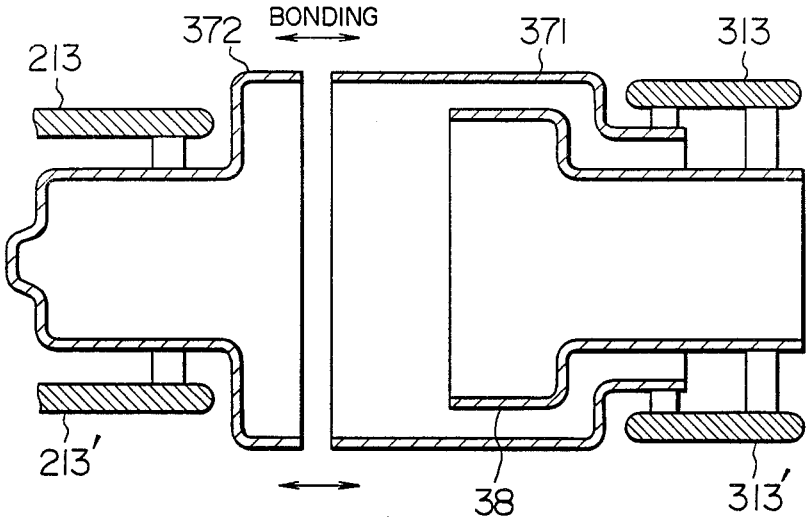
FIG. 5 is a diagrammatic cross-sectional view showing a principal lens according to a second embodiment of the present invention.

Referring to FIG. 5 which shows a second embodiment in which the special contrivance mentioned above is embodied, two members 371 and 372 are prepared, and the large-diameter portions of the respective members 371 and 372 are bonded to each other by laser welding, thereby forming the focusing electrode 37. In this structure, the accelerating electrode 38 is inserted into a predetermined position prior to the bonding of the members 371 and 372, and the accelerating electrode 38 and the member 371 are secured to each other by means of the electrode supporting rods 313 and 313'. Accordingly, it is possible to make the diameter of the opening of the accelerating electrode 38 as large as possible, concretely, as large as 16 mm, within the limits in which high-voltage resistance characteristics do not deteriorate.

Figure 6:
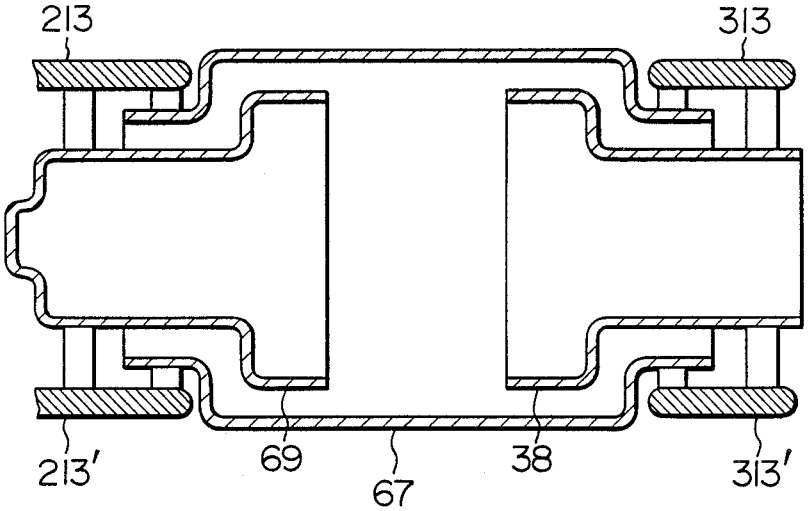
FIG. 6 is a diagrammatic cross-sectional view showing a principal lens according to a third embodiment of the present invention.

FIG. 6 shows a third embodiment in which electrodes to which accelerating voltages are applied are inserted into a focusing electrode from the opposite sides thereof to construct a so-called Hi-UPF principal lens.

In addition, by combining the electrode structures of FIG. 1 or 6 in a plurality of steps, it is possible to construct a multistep principal lens. Furthermore, the lens provided in a triode section which constitutes the multistep principal lens may not be a large-diameter lens such as that used in the embodiment shown in FIG. 1 or 6. For example, the lens of the triode section may be formed by an electrode whose opening is smaller in diameter than any reduced opening portion. This arrangement is easy to assemble.

Figure 7:
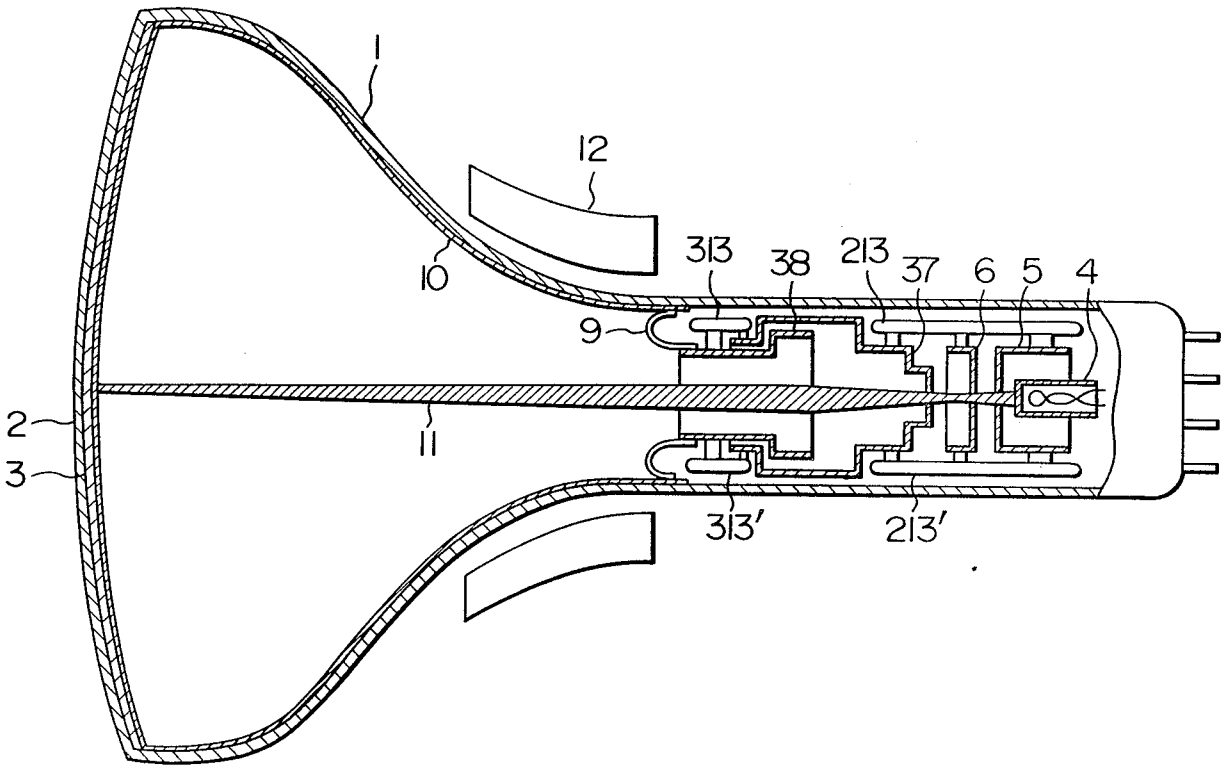
FIG. 7 is a diagrammatic cross-sectional view showing a cathode-ray tube according to the present invention.

FIG. 7 shows the construction of a cathode-ray tube in which the electron gun of FIG. 1 is incorporated in the envelope 1. As illustrated, the cathode 4, the G1 electrode 5, and the G2 electrode 6, which constitute in combination a triode section, as well as the focusing electrode 37 are spaced apart at predetermined intervals in the axial direction and secured in a coaxial relationship by means of electrode supporting rods 213 and 213'. The focusing electrode 37 and the accelerating electrode 38 are coaxially secured by means of the electrode supporting rods 313 and 313'. The longitudinal middle portion of the focusing electrode 37 has a diameter which is enlarged toward the inner surface of the neck of the envelope 1 at a location between the opposite electrode supporting rods 213, 213' and 313, 313'. The portion of the accelerating electrode 38 which is disposed in the focusing electrode 37 and which is closer to the cathode 4 has a diameter which is likewise enlarged.

Figure 8A:
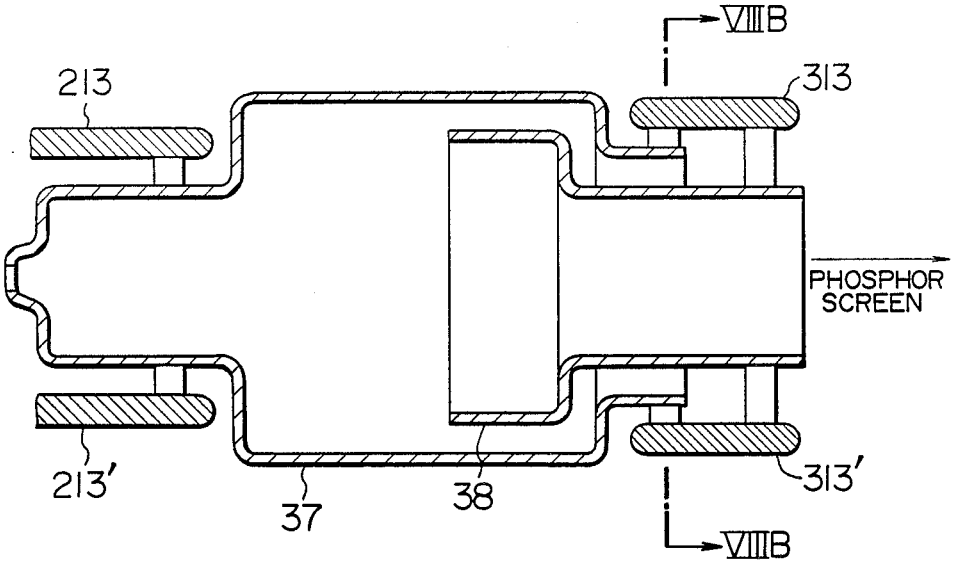
FIG. 8A is a diagrammatic cross-sectional view showing one modification of the present invention.
Figure 8B:
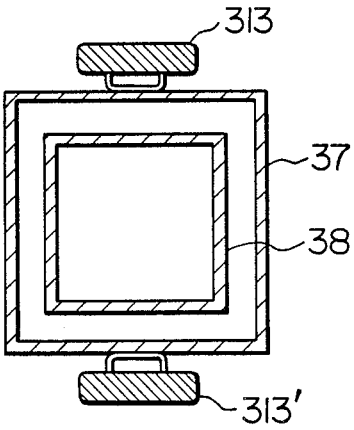
FIG. 8B is a cross-sectional view taken along line VIIIB of FIG. 8A.
Figure 9A:
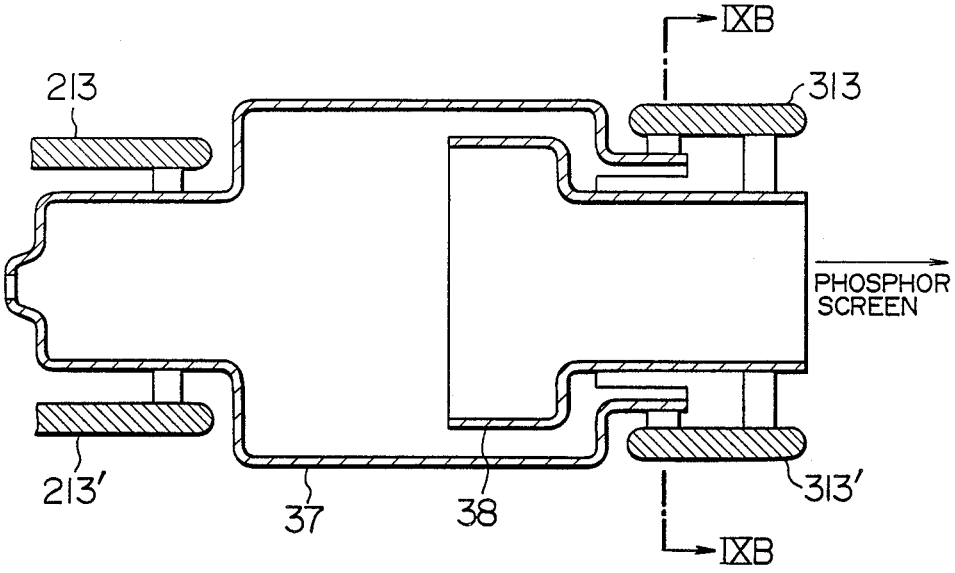
FIG. 9A is a diagrammatic cross-sectional view showing one modification of the present invention.
Figure 9B:
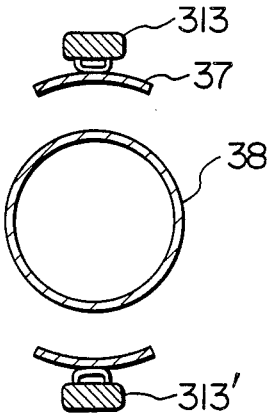
FIG. 9B is a cross-sectional view taken along line IXB of FIG. 9A.

Incidentally, each of the reduced opening portions of the focusing electrode 37 and the accelerating electrode 38 need not necessarily have a circular cross-sectional configuration as shown in FIG. 1, 5, 6 or 7 and, for example, an arbitrary polygonal configuration as shown in FIG. 8B may be employed. In addition, as shown in FIG. 9B, the cross-sectional configuration of the reduced opening portion of the focusing electrode 37 may be formed into a portion of a circle or an arbitrary polygon.

In accordance with the present invention, the diameter of the opening portion of a focusing electrode which constitutes a part of a principal lens can be made as large as possible without going beyond the limit at which the focusing electrode would come into contact with the inner surface of the neck of a glass envelope. Accordingly, it is possible to achieve the effect of reducing the spot diameter of an electron beam on a phosphor screen by virtue of a reduction in spherical aberration and hence of enhancing the resolution of a cathode-ray tube.

What is claimed is:

1. An electron gun for a cathode-ray tube, comprising:

electron-beam generating means for generating an electron beam and emitting said electron beam toward a phosphor screen;

a principal lens for focusing said electron beam on said phosphor screen;

said principal lens constituted by at least one set of electrodes, one electrode being a focusing electrode to which a low potential is given with the other electrode being an accelerating electrode to which a high potential is given;

said focusing electrode having an enlarged-diameter portion at its axial middle portion and reduced-diameter portions at its respective opposite end portions; and said accelerating electrode having opposite end portions, one of which is larger in diameter than the other, said one end portion being located in said enlarged-diameter portion of said focusing electrode with said other end portion inserted through one of said reduced-diameter portions of said focusing electrode, said other end portion and said one of said reduced-diameter portions being supported in a mutually insulated relationship by an electrode supporting rod.

2. An electron gun for a cathode-ray tube according to claim 1, wherein the outer diameter of said enlarged-diameter portion of said accelerating electrode is larger than the inner diameter of each of said reduced-diameter portion of said focusing electrode.

3. An electron gun for a cathode-ray tube according to claim 1, wherein said focusing electrode is constituted by at least two members, said at least two members being bonded to each other to constitute said enlarged-diameter portion of said focusing electrode.

4. An electron gun for a cathode-ray tube according to claim 1, wherein at least one of said reduced-diameter portions of said acelerating electrode and said focusing

5. An electron gun for a cathode-ray tube according to claim 1, wherein at least one of said reduced-diameter portions of said focusing electrode has a cross-sectional configuration which constitutes a part of a circle.

6. An electron gun for a cathode-ray tube according to claim 1, wherein at least one of said reduced-diameter portions of said focusing electrode has a cross-sectional configuration which constitutes a part of a polygon.

7. In a cathode-ray tube in which an electron gun is provided in the neck of a glass envelope having a face plate whose inner surface is coated with phosphor, said electron gun including a triode section constituted by a cathode, a first grid and a second grid as well as a principal lens constituted by at least one pair of a focusing electrode and an accelerating electrode, the improvement comprising:

said focusing electrode having an enlarged-diameter portion at its axial middle portion and reduced-diameter portions at its respective opposite end portions; and said accelerating electrode having an enlarged-diameter portion at one end portion opposing said cathode and a reduced-diameter portion at the other end portion, said enlarged-diameter portion of said accelerating electrode being located in said focusing electrode with said reduced-diameter portion of said accelerating electrode inserted through one of said reduced-diameter portions of said focusing electrode, said reduced-diameter portion and said one of said reduced-diameter portions being supported in a mutually insulated relationship by an electrode supporting rod.

8. In a cathode-ray tube in which an electron gun is provided in the neck of a glass envelope having a face plate whose inner surface is coated with phosphor, said electron gun including a triode section constituted by a cathode, a first grid and a second grid as well as a principal lens constituted by at least one pair of a focusing electrode and an accelerating electrode, the improvement comprising:

first electrode supporting means for securing said triode section and said focusing electrode in a coaxial relationship and at predetermined intervals in the axial direction;

second electrode supporting means for securing said focusing electrode and said accelerating electrode in a coaxial relationship;

said focusing electrode having at least its longitudinal middle portion with a diameter which is enlarged toward the inner surface of said neck of said glass envelope at a location between said first and second electrode supporting rods; and said accelerating electrode having a portion which is closer to said cathode and which is disposed in said focusing electrode as well as which has a diameter enlarged according to the diameter of said longitudinal middle portion of said focusing electrode.

* * * * *